US006244285B1

(12) United States Patent
Gamache

(10) Patent No.: US 6,244,285 B1
(45) Date of Patent: Jun. 12, 2001

(54) DEVICE TO ASSIST PERSON TO STAND

(76) Inventor: Lawrence W. Gamache, 7072 Flower La., St. Louis, MO (US) 63129

( * ) Notice: Subject to any disclaimer, the term of this patent is extended or adjusted under 35 U.S.C. 154(b) by 0 days.

(21) Appl. No.: 09/264,121

(22) Filed: Mar. 8, 1999

Related U.S. Application Data

(63) Continuation-in-part of application No. 08/717,062, filed on Sep. 20, 1996, now abandoned.

(51) Int. Cl.[7] ..... A61H 3/00; A47C 31/00

(52) U.S. Cl. ..... 135/67; 135/66; 135/76; 5/662; 5/503.1; 5/426; 5/81.1 R

(58) Field of Search ..... 135/66, 65, 67, 135/76, 75; 5/662, 503.1, 658, 425–426, 81.1 R, 84.1; 297/5–6, 411.7; 248/155.1, 370, 158

(56) References Cited

U.S. PATENT DOCUMENTS

| | | | | |
|---|---|---|---|---|
| 2,757,388 | | 8/1956 | Chisholm . | |
| 3,176,322 | | 4/1965 | Mulcahy . | |
| 3,553,746 | | 1/1971 | Seiger . | |
| 3,613,132 | | 10/1971 | Weinhart . | |
| 3,668,723 | | 6/1972 | Bratton . | |
| 4,127,907 | * | 12/1978 | Fleischer | 248/158 X |
| 4,834,128 | * | 5/1989 | Burgess | 135/88.06 |
| 4,843,661 | | 7/1989 | Skibinski . | |
| 4,844,107 | | 7/1989 | Watkins . | |
| 4,894,871 | | 1/1990 | Schmerler . | |
| 4,922,560 | | 5/1990 | Skibinski . | |
| 4,932,090 | | 6/1990 | Johansson . | |
| 5,007,618 | | 4/1991 | Libby . | |
| 5,044,025 | | 9/1991 | Hunsinger et al. . | |
| 5,123,131 | | 6/1992 | Jandrakovic . | |
| 5,195,200 | | 3/1993 | Leoutsakos . | |
| 5,226,439 | | 7/1993 | O'Keeffe et al. . | |
| 5,239,713 | | 8/1993 | Toivio et al. . | |
| 5,327,592 | | 7/1994 | Stump . | |
| 5,337,430 | | 8/1994 | Schlein . | |
| 5,347,666 | | 9/1994 | Kippes . | |
| 5,354,022 | | 10/1994 | Coonrod . | |
| 5,384,927 | | 1/1995 | Mardero et al. . | |
| 5,435,028 | | 7/1995 | Frala . | |
| 5,437,067 | | 8/1995 | Bernstein et al. . | |
| 5,465,744 | | 11/1995 | Browning . | |
| 5,509,432 | | 4/1996 | Peterson . | |

* cited by examiner

*Primary Examiner*—Carl D. Friedman
*Assistant Examiner*—Winnie Yip
(74) *Attorney, Agent, or Firm*—Polster, Lieder, Woodruff & Lucchesi

(57) ABSTRACT

The present invention relates to a free standing support device without a base mat, to assist a person to come to a standing position from a sitting or lying position. The device has a base frame to which are attached two and only two, vertical posts each extending about 30 inches above the floor and each having a free end and a fixed end. At least one vertical post has a free end separable from its fixed end. The vertical posts each have a gripping means affixed to the free end.

4 Claims, 2 Drawing Sheets

DEVICE TO ASSIST PERSON TO STAND

CROSS-REFERENCE TO RELATED APPLICATIONS

This application is a continuation-in-part of application U.S. Ser. No. 08/717,062, filed Sep. 20, 1996 now abandoned.

STATEMENT REGARDING FEDERALLY SPONSORED RESEARCH OR DEVELOPMENT

Not applicable.

BACKGROUND OF THE INVENTION

The present invention relates to a free standing support device to assist a person to come to a standing position from a sitting or lying position.

When a person has become ill or injured or is weak from age, it becomes difficult to come to a standing position from either a sitting position or a lying position. Many devices have been devised to provide the necessary assistance.

Most desirably, a support device will be free-standing without a base mat in order to allow easy placement and removal of the device either by the person needing the device or an assistant. Furthermore any such device must be stable so as to allow the person to pull on the device when requiring assistance. The device should be a simple device and easy to manufacture at relatively low cost. It also is desirable for the device to be dismantled easily so as to allow storage in a small area. In addition, the support device should be utilizable along side a bed or with a chair to allow the person to assume a standing position.

U.S. Pat. No. 3,176,322 to Mulcahy provides a bedside support which has two guard rail type ends spaced apart with support on one side of the guard rails which support would be placed against the bed when using the device. Two further support bars which extend backward under the mattress are also provided. The device however, does not allow one to readily swing ones legs over the side of the bed after the device is in place. Hence, a person using the device would require assistance at the time of use of the device.

U.S. Pat. No. 3,553,746 to Seiger provides a support device which consists of a single post supported by a support mechanism which is I-shaped and lying on the floor. The single post extends upwardly from the I support and has gripping means on each side of the post. A portion of the I support to one side of the post is slipped under the bed for stability. A person using the device however, when using two hands to attempt to stand would find the mechanism immediately in front of them and hence would need to either have the mechanism removed or step to the side from the mechanism to walk away from the device.

U.S. Pat. No. 3,668,723 to Bratton provides a patient riser which consists of two vertical posts having parallel bars placed between the posts, the posts being positioned up against the bed and subsequently after the patient is in a seated position, a U-shaped configuration of horizontal parallel bars is positioned around the patient with the front open and the bottom portion being affixed to the top of the vertical posts. This configuration does not assist the patient in getting from a prone position to a sitting position and furthermore, would require assistance by another party to place the horizontal portion in position before the patient could use the device.

U.S. Pat. No. 4,932,090 to Johansson provides a movable support bar which bar can be affixed to the floor or to the side of a chair or bed to allow a patient to pull on the bar to come to a seated or standing position. The support bar requires affixing the mechanism to a stable base such as the floor, a bed, or a chair.

U.S. Pat. No. 5,354,022 to Coonrod provides a patient assist device having a base and a single patient support structure coupled with the base and if desired, a means for coupling the device to the article of furniture to prevent movement of the apparatus relative to the article of furniture. In order to use the device, the person must place their feet on the base of the device and then utilize the device. Such a device does not assist one for rising from a lying position to a sitting position and in order to be stable, the device needs to be coupled to an article of furniture.

U.S. Pat. No. 5,347,666 to Kippes provides a transfer aid for assisting people with restricted mobility to rise from a seated position to a standing position. The device is substantially U-shaped and is in front of and along each side of the person using the device. Hence, when the user arises from a seated position to a standing position, the device is still surrounding the user on three sides, thereby requiring assistance from another person to remove the device so the user can then continue to move to a different position.

U.S. Pat. No. 5,435,028 to Frala provides a portable support apparatus consisting of a single handrail extending vertically from the floor with several support pieces lying on the floor and attached to the rail. When using this device, only one hand provides assistance and when standing, a portion of the forwardmost base lies in front of the standing person such that the user must step over the support before commencing to walk.

U.S. Pat. No. 5,509,432 to Peterson provides a complex device with a base mat and four posts with stabilizing bars between each set of two posts. The device does not easily dissassemble nor does it allow for swinging one leg over the side rail to move from a lying position to a sitting position and thence to a standing position.

The present invention provides a free standing support device without a base mat, to assist a person to come to a standing position from a sitting or lying position such that the device is easily portable, may be easily dismantled to allow compact storage, provides support for both hands and is very stable.

SUMMARY OF THE INVENTION

The present invention provides a free-standing support device without a base mat, to assist a person to come to a standing position from a sitting or lying position, which device has a base frame having two parallel elongated flat pieces each having a front portion and a rear portion. One side of each elongated flat piece rests on the floor and to the other side on the rear portion thereof are affixed at least two parallel support bars perpendicular to the pieces. Two and only two vertical posts are present, each having a fixed end and a free end, one each being affixed to the front portion of one of the flat pieces, the vertical posts extending about 30 inches above the floor. At least one of the posts is comprised of two pieces, one piece being the free end and the other piece being the fixed end. These pieces are separable so that the free end can be removed easily and subsequently put back in place.

A gripping means is affixed to the free end of each vertical post and extends forward and parallel to the flat piece below it being positioned above the front portion of the flat piece. When being used, the rear portion of the flat pieces containing the parallel support bars is placed under the article of furniture, e.g. a chair or a bed. The vertical posts generally are placed against the article of furniture in such a manner that the gripping means extend forward from the edge of the article of furniture. Thus, when a person using the device places one hand on each of the gripping means and rises to a standing position, no part of the device lies in front of the user. Thus, the user may just walk away.

The base frame and the two vertical posts of the device are made from wood, metal, plastic or other suitable stable material. The vertical posts are affixed to the base frame by conventional means such as welding, gluing, use of bolts or the like. The parallel support bars are preferably affixed to the flat pieces by wing bolts or other suitable attaching means which is easily removed so as to allow the device to be separated into the flat pieces with the vertical posts attached and the support bars. Thus the device is easily stored in a narrow space. The free end of at least one of the posts is movable and can simply be hung on the gripping means of the other post so that when rising from a lying position to a sitting position, the user may swing his legs over the fixed end of the post and thus easily assume a position to allow the user to thereafter stand. The removed free end of the post is subsequently put back in place and the device is ready to be used for standing.

DETAILED DESCRIPTION OF THE INVENTION

Figure 1:
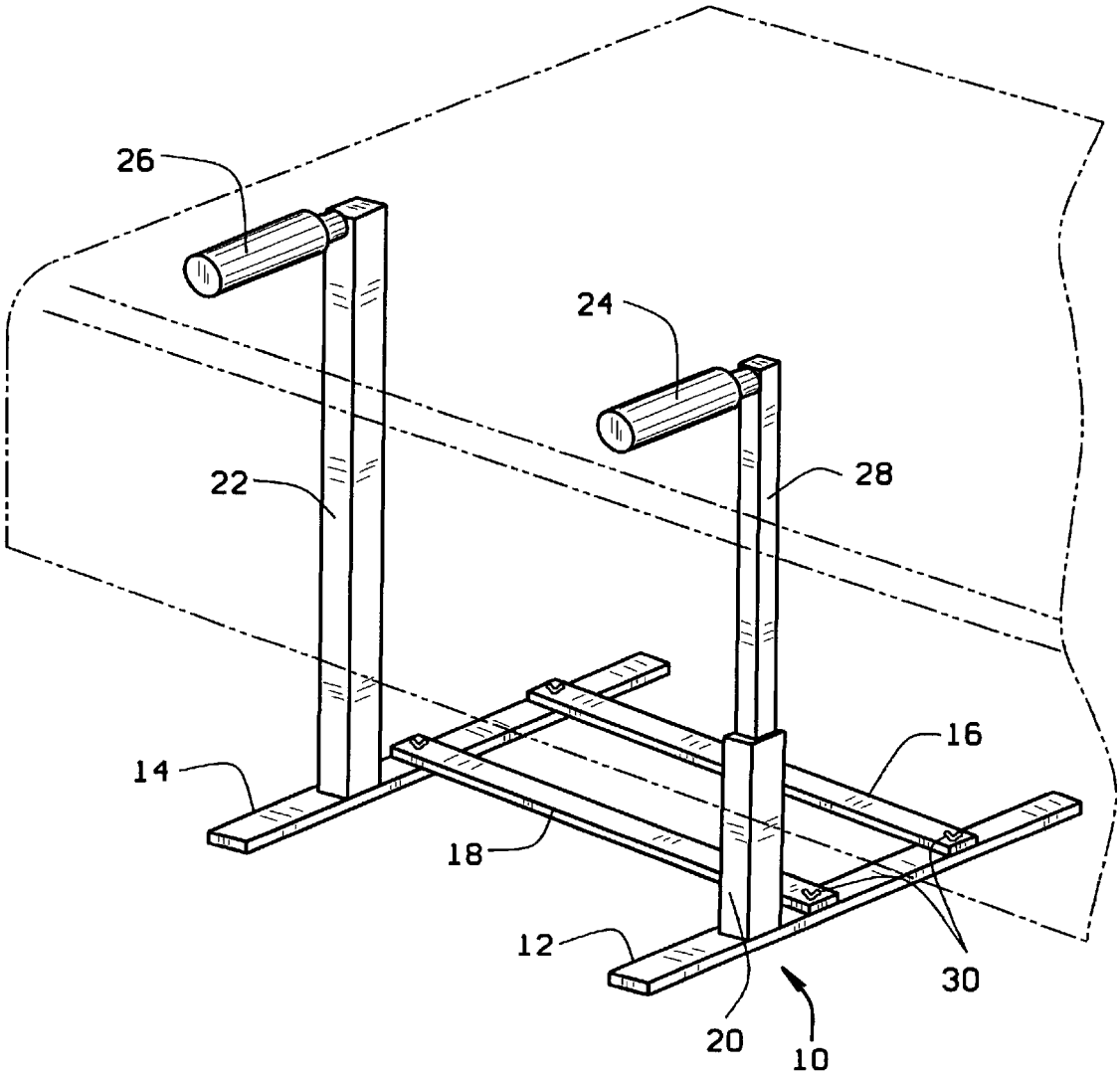
FIG. 1 is a perspective view of one embodiment of the present invention.
Figure 2:
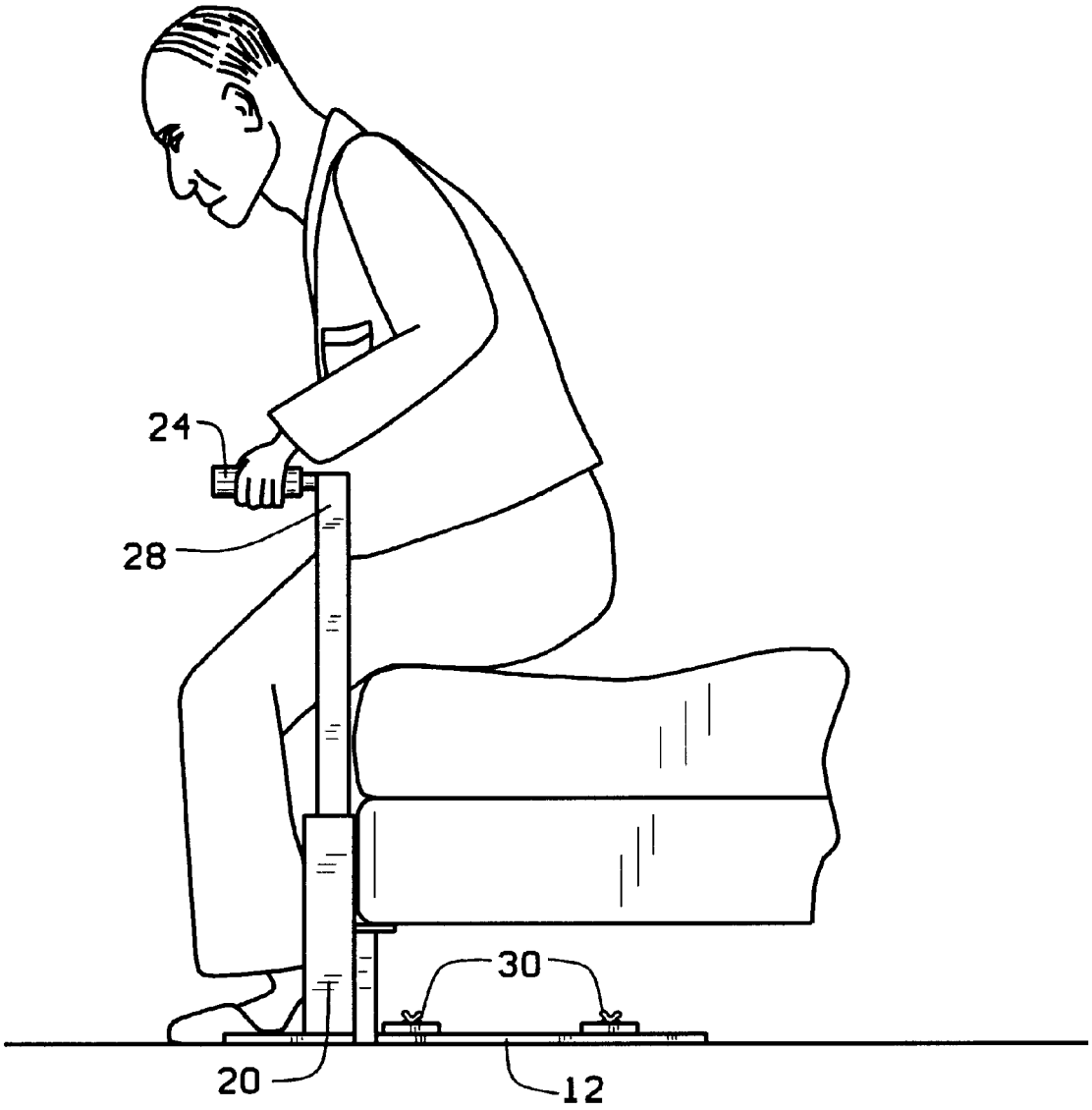
FIG. 2 is a side elevational view depicting a user using one embodiment of the present invention.

FIG. 1 is a perspective view of a support device 10. The device has a base frame with two parallel elongated flat pieces 12 and 14. To the flat pieces 12 and 14 are affixed two parallel support bars 16 and 18. The support bars preferably are affixed in such a manner as to be easily removable such as by wing bolts 30. When the support bars 16 and 18 are removed, the flat pieces 12 and 14 may be placed one against another to allow storage in a narrow space.

Two and only two, vertical posts 20 and 22 are attached to the flat pieces 12 and 14 respectively. The vertical posts 20 and 22 extend about 30 inches above the floor. In the embodiment depicted in FIG. 1, the vertical post 20 is separable into a free end 28 and the portion affixed to the flat piece 12. The free end 28 is readily removable from the fixed portion and may be subsequently put back in place at the time of use. By removing the free end 28 from the fixed portion, the user is able to swing his legs from the bed around to place the feet on the floor or the reverse. After the user places his feet on the floor and has assumed a sitting position, the free end 28 is put back in place into the fixed end of the vertical post 20. Thus the support device 10 is ready for use. The user next grips the gripping means 24 and 26 placed at the free end of the vertical posts 20 and 22 respectively. Inasmuch as the back side of the vertical posts 20 and 22 are placed against the article of furniture, e.g. a bed, when the user rises to a standing position, it is necessary only to walk away from the device as no part of the device obstructs the walking of the user.

The gripping means 24 and 26 are approximately 29 or 30 inches above the floor where the device is placed. The location of the gripping means in relationship to the overall device 10 and to the floor is somewhat critical to the function of the device. For instance, it should be noted that adult humans when standing, almost regardless of height, will have the gripping portion of their hands reach approximately 29 or 30 inches from the floor. A person, 6'5" tall will have the gripping portion of his hands in substantially the same position from the floor as a person 5'4" tall. By placing the gripping means in this position, a person may assume a standing position from a sitting position with the least effort.

The distance between the elongated flat pieces most generally will approximate 20 to about 25", thus allowing for a large or a small person to stand therebetween. The length of the front portion of each of the flat pieces 12 and 14 including the vertical posts 20 and 22 is generally less than about half the length of the remaining distance of the elongated flat pieces. It has been found that the length extending forward beyond the vertical posts need not be very long at all to supply stability to the support device. This is indeed surprising, but apparently the fact that the gripping means are forward of the vertical posts, places weight or pressure as the person is standing in the ideal location to provide stability.

The affixed portion of a vertical post which is separable into the free end and the affixed end should be short enough that it does not extend above the seat of a chair or the mattress of a bed from which the user is rising in order to prevent interference with the user.

I claim:

1. A free standing support device without a base mat, to assist a person to come to a standing position from a sitting or lying position, comprising:

(a) a base frame having two parallel elongated flat pieces each having a front portion and a rear portion, one side of each piece being adapted to rest on a floor and to the other side on the rear portion is affixed at least two parallel support bars perpendicular to the pieces, (b) two and only two, vertical posts, each having a fixed end and a free end, each post having the fixed end affixed to the front portion of one of the two flat pieces, at least one of the posts having the free end separable from the fixed end so that the free end can be removed from the fixed end to allow a person's leg crossing over and subsequently put back in place with adjustable height to allow the person to use for standing, the posts being spaced apart far enough to permit a person using the device to walk between them; and (c) a gripping means affixed at the upper end of the free end of each vertical post, the gripping means extending in a direction toward the front of and parallel to the flat piece and being positioned above the front portion of the flat piece.

2. The device of claim 1 wherein the length of the front portion of each flat piece is less than one half the length of the rear portion.

3. The device of claim 1 wherein the separable free end and fixed end are substantially equal in length.

4. The device of claim 1 wherein the vertical posts extend about 30 inches above the flat pieces.

* * * * *